US006110306A

United States Patent [19]

Consaga

[11] Patent Number: 6,110,306

[45] Date of Patent: Aug. 29, 2000

[54] COMPLEXED LIQUID FUEL COMPOSITIONS

[75] Inventor: John P. Consaga, La Plata, Md.

[73] Assignee: The United States of America as represented by the Secretary of the Navy, Washington, D.C.

[21] Appl. No.: 09/443,120

[22] Filed: Nov. 18, 1999

[51] Int. Cl.[7] ..... C06B 25/02; C06B 25/24; C06B 25/26; C06B 25/20; C06B 25/12

[52] U.S. Cl. ..... 149/108; 149/97; 149/98; 149/100; 149/102; 149/1

[58] Field of Search ..... 149/108, 97, 98, 149/100, 102, 1

[56] References Cited

U.S. PATENT DOCUMENTS

| | | | |
|---|---|---|---|
| 3,923,564 | 12/1975 | Lantz | 149/19.8 |
| 3,963,545 | 6/1976 | Thomas et al. | 149/92 |
| 3,989,776 | 11/1976 | Dunigan et al. | 264/3 |
| 4,082,583 | 4/1978 | Mosher | 149/96 |
| 4,298,411 | 11/1981 | Godsey | 149/19.4 |
| 4,298,552 | 11/1981 | Gimler | 264/3 |
| 4,521,261 | 6/1985 | Davies | 149/92 |
| 5,114,506 | 5/1992 | Consaga et al. | 149/88 |
| 5,398,612 | 3/1995 | Graham et al. | 102/287 |
| 5,440,993 | 8/1995 | Osofsky | 102/374 |
| 5,639,987 | 6/1997 | Berteleau et al. | 149/19.8 |
| 5,652,409 | 7/1997 | Thompson et al. | 149/98 |
| 5,660,845 | 8/1997 | Trinh et al. | 424/418 |

*Primary Examiner*—Charles T. Jordan
*Assistant Examiner*—Glenda L. Sánchez
*Attorney, Agent, or Firm*—Mark Homer

[57] ABSTRACT

This invention relates to liquid propellant compositions containing an energetic material of organic nitrate esters. The organic nitrate esters of the present invention are complexed with a nitrate ester plasticizer, bismuth subsalicylate, and stabilizer to form liquid compositions with an appropriate energy, stability, and sensitivity that is useful as a propellant.

14 Claims, No Drawings

COMPLEXED LIQUID FUEL COMPOSITIONS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to liquid propellants. More particularly, the liquid propellants of the present invention contain an energetic material of organic nitrate esters. Most particularly, the organic nitrate esters of the present invention are complexed with a nitrate ester plasticizer, bismuth subsalicylate and stabilizer to form liquid compositions with an appropriate energy, stability and sensitivity that is useful as a propellant.

2. Brief Description of the Related Art

Several types of energetic compositions are known. U.S. Pat. No. 5,114,506 to Consaga et al. discloses an energetic gun propellant or explosive composite having a solid nitrate ester of cyclodextrin and nitroglycerin. U.S. Pat. No. 5,440,993 to Osofsky discloses a high velocity rocket containing nitroglycerin and nitrocellulose. U.S. Pat. No. 5,639,987 to Berteleau et al. discloses a solid prope nitroglycerin and bismuth salicylate. U.S. Pat. No. 5,652,409 to Thompson et al. discloses a non-complexed solid double-based propellant having cyclodextrin nitrate, nitroglycerin, and bismuth salicylate. However, the identified explosive compositions are not complexed, lack sufficiently stability and/or lack the requisite components to be suitable as a liquid fuel composition.

In view of the foregoing, there is a need for a highly energetic material useful as a liquid fuel propellant. The present invention addresses this need.

SUMMARY OF THE INVENTION

The present invention includes a complexed liquid fuel composition comprising a cyclodextrin nitrate, a nitrate ester plasticizer, bismuth subsalicylate and a stabilizer, wherein the cyclodextrin nitrate, nitrate ester plasticizer, bismuth subsalicylate and stabilizer are complexed together into an energetic compound.

The present invention also includes a method for propulsion comprising the steps of inputing into a combuster a complexed liquid fuel composition comprising a cyclodextrin nitrate, a nitrate ester plasticizer, bismuth subsalicylate and a stabilizer, and reacting the complexed liquid fuel composition in the combuster, wherein thrust is produced.

DETAILED DESCRIPTION OF THE PREFERRED EMBODIMENT

The present invention relates generally to energetic materials useful as liquid propellants. The energetic materials are complexed compositions containing cyclodextrin nitrates, nitrate ester plasticizers, bismuth subsalicylate and stabilizers. The composition is used in a method for propulsion that allows an appropriate energy, stability and sensitivity that is useful as a liquid propellant.

Liquid fuel compositions of the present invention provide "free movement" of the composition without a tendency to separate. The free movement liquid characteristics of the present invention provide flow, and may be pumped, from one location into another, such as into a combuster. Generally, the viscosity of the liquid of the present invention is slightly higher than water.

The cyclodextrin nitrates, nitrate ester plasticizers, bismuth subsalicylate and stabilizer are processed into complexed energetic compositions of the present invention. Complexed compositions include an intermolecular attraction, i.e., dipole-dipole or ion-dipole, between the component parts of the composition, i.e., the cyclodextrin nitrates, nitrate ester plasticizers, bismuth subsalicylate and stabilizer are "tied" to one another within the complexed composition. As such, the component parts of the composition tend to act as a single ingredient or material, which may be evidenced by composition characteristics, such as a raised boiling point. By contrast, mixed components that are not complexed within a composition retain the individual characteristics of each component. Complexing may be imparted into the composition of the present invention with the addition of heat and mechanical energy, i.e., shear, under vacuum, in an appropriate medium, such as acetone. For example, the individual components of the present invention are mixed together in acetone or other like medium at an elevated temperature, with the medium selected for its ability to dissolve the components and be removed at modest temperatures, i.e., temperatures that are not damaging to the complexing components. Vacuum is applied while mechanical energy is placed into the component parts. Mechanical energy is preferably in the form of shear mixing, using shear blades to mix the composition. The acetone medium permits the components to dissolve, particularly the cyclodextrin nitrates. As low elevated temperatures strip the medium from the mixed components in an evacuated environment, the shearing complexes the components in the composition. Preferably, acetone is used with temperatures of from about 140° F. or higher, and pressures of from about 25–30 mm Hg that are continuously decreased to about 3 mm Hg over a period of from about 1 to about 4 hours.

Cyclodextrin nitrate compounds of the present invention include energetic materials such as α-cyclodextrin, β-cyclodextrin, γ-cyclodextrin, and mixtures thereof. The preferred cyclodextrin nitrate comprises γ-cyclodextrin nitrate. γ-cyclodextrin nitrate is particularly desirable because the maximum energy potential of the γ-cyclodextrin nitrate is significantly higher than other cyclodextrin nitrate compounds, while it retains significant stability. The γ-cyclodextrin nitrate, with 24 available —OH groups, possesses a larger cavity, allowing for approximately an 80% increase in cavity size from β-cyclodextrin nitrate, which has 21 —OH groups, and significantly greater increase over α-cyclodextrin with 18 —OH groups. Each D-glucose unit in a cyclodextrin compound has three free —OH groups capable of being nitrated to a nitrate ester group of —ON$\mathbf{0}_2$. Preferably an average of from about 2 to about 3, more preferably from about 2.5 to about 3, and most preferably from about 2.6 to about 3 nitrate ester groups (—$ONO_2$) per D-glucose unit are present in the nitration product of the α-cyclodextrin, β-cyclodextrin or γ-cyclodextrin nitrate ester, either individually or within various mixtures thereof. Different α-cyclodextrin nitrate esters, based on the same basic α-cyclodextrin moiety, differ from each other in the degree of nitration, i.e., nitrate ester unit content. Likewise, different β-cyclodextrin nitrate esters differ from each other in the degree of nitration, as do different γ-cyclodextrin nitrate esters.

The cyclodextrins of the present invention may be nitrated using conventional techniques that are used in the preparation of nitrocellulose, with the degree of nitration controlled by varying the nitration conditions. Formation of the cyclodextrins is disclosed in U.S. Pat. No. 5,114,506 to Consaga et al., issued May 19, 1992, the disclosure of which is herein incorporated by reference. Commercial γ-cyclodextrins are available from Wacker-Bio-chem of Edieville, Iowa under the tradename Cavamax-W8.

The cyclodextrin nitrate esters of the present invention provide useful replacements for energetic organic nitrate ester plasticizers within the liquid fuel composition as the cyclodextrin nitrate esters increase the thermal stability and decrease the shock sensitivity of the liquid fuel composition of the organic nitrate ester plasticizers. The cyclodextrin nitrate esters also possess comparable or greater energy content than the organic nitrate ester plasticizers. As dry powders, the cyclodextrin nitrate esters are sensitive to electrostatic discharge (ESD), e.g., β-cyclodextrin nitrate ester (β-CDN) ($C_{42}H_{52}N_{18}O_{71}$) has an ESD value of only 0.0125 joules. When the organic nitrate ester plasticizer of 1,1,1-trimethylolethane trinitrate (TMETN), having an ESD value of 12.5 joules, is mixed with β-CDN (2:1 weight ratio), the resulting composite mixture has a liquid consistency and a resultant ESD value of 12.5 joules. The composite mixture, however, has a low shock sensitivity.

The cyclodextrin starting materials comprise cyclic structures having 1,4-α-glucosidically linked D-glucose units, preferably being α-cyclodextrin with 6, β-cyclodextrin with 7, γ-cyclodextrin with 8 glucosidically linked D-glucose units, or mixtures of these compounds. A preferred embodiment of the present invention comprises an energetic composite comprising a nitrate ester of γ-cyclodextrin with a majority of the —OH groups fully nitrated, and an organic nitrate ester plasticizer of 1,1,1-trimethylolethane trinitate. Preferably, the weight ratio of the 1,1,1-trimethylolethane trinitate to the nitrate ester of γ-cyclodextrin ranges from about 2:1 to about 6:1 or less, and more preferably from about 2:1 to about 5:1.

The cyclodextrin nitrate preferably comprises from about 20 wt % to about 50 wt % of the complexed liquid fuel composition, more preferably from about 25 wt % to about 40 wt %, and most preferably approximately 32.5 wt % of the complexed liquid fuel composition.

Suitable nitrate ester plasticizers of the present invention that are complexed with the cyclodextrin nitrate are determinable by those skilled in the art, by considering the energy potential and sensitivity desired. Preferred energetic organic nitrate ester plasticizers include 1,1,1-trimethylolethane trinitate (TMETN), 1,2,4-butanetriol trinitrate (BTTN), triethylene glycol dinitrate (TEGDN), nitroglycerin (NG), 1,2-propyleneglycol dinitrate (PGDN), pentaerythritol trinitrate (PETRIN), diethylene glycol dinitrate (DEGN), and combinations or mixtures of these compounds. More preferred energetic organic nitrate ester plasticizers include the individual compounds or mixtures of 1,1,1-trimethylolethane trinitrate, 1,2,4-butanetriol trinitrate, triethylene glycol dinitrate, and nitroglycerin. Nitroglycerin is most preferred, which is commercially available from Naval Surface Warfare Center, Indian Head, Md.

Operable amounts of cyclodextrin nitrate ester to energetic organic nitrate ester plasticizer vary with the choice of cyclodextrin nitrate ester and energetic nitrate ester plasticizer, but generally range from about 1:1 to about 1:6 with amounts of 1:2, 1:3 and 1:4 operable with at least enough plasticizer to convert the powdery cyclodextrin nitrate ester into a liquid composition. With the combination of the cyclodextrin nitrate ester and nitrate ester plasticizer, the ESD of the nitrate ester plasticizer decreases to about that of the cyclodextrin nitrate ester while retaining the low shock sensitivity of the cyclodextrin nitrate ester. However, excessive amounts of the nitrate ester plasticizer cause a saturation point to be reached, after which the plasticizer remains separate or neat, i.e., not complexed, from the composition with the neat plasticizer retaining high shock sensitivity.

Generally, the amount of nitrate ester plasticizer ranges from about 50 wt % to about 80 wt % of the complexed liquid fuel composition, with amounts of from about 60 wt % to about 75 wt % more preferred, and an amount of approximately 65 wt % of the complexed liquid fuel composition most preferred.

Bismuth subsalicylate is an acetone soluble complexing component with the cyclodextrin nitrate ester and nitrate ester plasticizer that provides a burn rate modifier to the liquid fuel composition and a complex stabilizer. As such, the bismuth subsalicylate inhibits the breakup of the liquid fuel composition into its component parts. This imparts significant safety to the liquid fuel composition in storage, handling and manufacturing. Preferably, the bismuth subsalicylate comprises from about 0.75 wt % to about 1.5 wt % of the complexed liquid fuel composition. Bismuth subsalicylate is commercially available from Pfaltz & Bauer, Inc. of Waterburg, Conn.

The stabilizer component of the present invention comprises a stabilizing compound having a pH of from about 7 or less to ensure decomposition of the nitrate ester does not occur. Preferably, the stabilizer comprises an acidic or neutral amide, with more preferred stabilizers including 2-nitrodiphenyl amine (2NDPA), methylnitroaniline (MNA) and/or combinations thereof. Preferred amounts of stabilizer range from about 1 wt % to about 2 wt % of the complexed liquid fuel composition.

Increases in the amount of cyclodextrin nitrate ester, bismuth subsalicylate and/or stabilizer in relation to the nitrate ester plasticizer on average cause a decrease in the amount of available energy of the liquid fuel composition. The appropriate relative amounts of these components for a particular liquid fuel composition is determinable by those skilled in the art, generally as a factor of the liquidity and available energy of the complexed composition. As additional components tend to decrease the available energy within the complexed components, other energetic and non-energetic components generally are not added to control the liquidity and available energy of the complexed composition.

Propulsion is created by inputting the complexed liquid fuel composition into a combuster, reacting the complexed liquid fuel composition, and allowing a controlled release of the reaction product. Combusters are known in the art, generally comprising any suitable reaction chamber designed for propulsion with the reaction of a highly energetic chemical composition, including reaction chambers for missiles, rockets, space vehicles, and other such propelling apparatuses. Reacting may be accomplished by an ignition or heat source sufficient for the complexed composition to initiate continuous combustion. Combustion is maintained with the continuous feeding of unreacted complexed liquid fulel composition into the combuster. Proper release of the resulting gases from the combustion within the combuster provides thrust.

The complex of the cyclodextrin nitrate, nitrate ester plasticizer, bismuth subsalicylate and stabilizer provides a particularly suitable liquid fuel for a limited fuel source for extended flight. Combinations of the γ-cyclodextrin nitrate and nitroglycerin complexed with the bismuth subsalicylate and stabilizer are particularly useful for a large energy source from a relatively small amount of composition. Compositions range from about 25 wt % to about 40 wt % γ-cyclodextrin nitrate, from about 60 wt % to about 75 wt % nitroglycerin, from about 1 wt % to about 2 wt % bismuth subsalicylate and from about 1 wt % to about 2 wt % stabilizer. Most preferred liquid fuel compositions include approximately 32.5 wt % γ-cyclodextrin nitrate, 65 wt % nitroglycerin, 1.05 wt % bismuth subsalicylate and 1.4 wt % 2NDPA.

The following examples illustrate suitable combinations of the cyclodextrin nitrate, nitrate ester plasticizer, bismuth subsalicylate and stabilizer of the present invention that are expected to provide highly energetic liquid fuel compositions.

EXAMPLE 1

In a first step, 340 grams of γ-cyclodextrin is mixed with 670 grams of nitroglycerin, and 11 grams of bismuth subsalicylate in 3 liters of acetone. The γ-cyclodextrin and nitroglycerin are stored in 1 wt % 2-nitrodiphenyl amine which is included in the acetone. The mixture is stirred in a Baker-Perkins vertical mixer, manufactured by Baker-Perkins of Saginaw, Mich., for 30 minutes at a temperature of 140° F. under a pressure of 20 mm Hg. In a second step, another 340 grams of γ-cyclodextrin (with 1 wt % 2-nitrodiphenyl amine), 670 grams of nitroglycerin (with 1 wt % 2-nitrodiphenyl amine), and 11 grams of bismuth subsalicylate are added with 3 liters of acetone, and heated and stirred for 30 minutes at a temperature of 140° F. under a pressure of 20 mm Hg. The second step is repeated a third and fourth time under similar conditions. After the fourth step, the mixture is maintained at 140° F. for 120 minutes with the pressure gradually decreased to 3 mm Hg by the end of the first 60 minutes, with the pressure maintained at 3 mm Hg through the second 60 minute period. The resulting liquid is analyzed under thermogravimetric analysis (TGA) to verify complexation of the composition and removal of the acetone, with the nitroglycerin that normally peaks at 130–135° F., expected to peak at approximately 165–170° F.

EXAMPLE 2

In a first step, 350 grams of γ-cyclodextrin is mixed with 630 grams of 1,1,1-trimethylolethane trinitrate, and 10 grams of bismuth subsalicylate in 2.5 liters of acetone. The γ-cyclodextrin and 1,1,1-trimethylolethane trinitrate are stored in 1 wt % 2nitrodiphenyl amine which is included in the acetone. The mixture is stirred for 30 minutes at a temperature of 150° F. under a pressure of 20 mm Hg. In a second step, another 350 grams of γ-cyclodextrin (with 1 wt % 2-nitrodiphenyl amine), 630 grams of 1,1,1-trimethylolethane trinitrate (with 1 wt % 2-nitrodiphenyl amine), and 10 grams of bismuth subsalicylate are added with 2.5 liters of acetone, and heated and stirred for 30 minutes at a temperature of 150° F. under a pressure of 20 mm Hg. The second step is repeated a third and fourth time under similar conditions. After the fourth step, the mixture is maintained at 150° F. for 120 minutes with the pressure gradually decreased to 3 mm Hg by the end of the first 60 minutes, with the pressure maintained at 3 mm Hg through the second 60 minute period. The resulting liquid is analyzed under thermogravimetric analysis (TGA) to verify complexation of the composition and removal of the acetone, with the 1,1,1-trimethylolethane trinitrate that normally peaks at 133° F., expected to peak at approximately 165–170° F.

EXAMPLE 3

In a first step, 340 grams of α-cyclodextrin is mixed with 670 grams of 1,2,4-butanetriol trinitrate, and 11 grams of bismuth subsalicylate in 3 liters of acetone. The (α-cyclodextrin and 1,2,4-butanetriol trinitrate are stored in 1 wt % methylnitroaniline which is included in the acetone. The mixture is stirred for 30 minutes at a temperature of 140° F. under a pressure of 20 mm Hg. In a second step, another 340 grams of α-cyclodextrin (with 1 wt % methylnitroaniline), 670 grams of 1,2,4-butanetriol trinitrate (with 1 wt % methylnitroaniline), and 11 grams of bismuth subsalicylate are added with 3 liters of acetone, and heated and stirred for 30 minutes at a temperature of 140° F. under a pressure of 20 mm Hg. The second step is repeated a third and fourth time under similar conditions. After the fourth step, the mixture is maintained at 140° F. for 120 minutes with the pressure gradually decreased to 3 mm Hg by the end of the first 60 minutes, with the pressure maintained at 3 mm Hg through the second 60 minute period. The resulting liquid is analyzed under thermogravimetric analysis (TGA) to verify complexation of the composition and removal of the acetone, with the 1,2,4-butanetriol trinitrate that normally peaks at 135–140° F., expected to peak at approximately 165–170° F.

EXAMPLE 4

In a first step, 340 grams of β-cyclodextrin is mixed with 670 grams of TMETN, and 11 grams of bismuth subsalicylate in 3 liters of acetone. The β-cyclodextrin and triethylene glycol dinitrate are stored in 1 wt % methylnitroaniline which is included in the acetone. The mixture is stirred for 30 minutes at a temperature of 140° F. under a pressure of 20 mm Hg. In a second step, another 340 grams of β-cyclodextrin (with 1 wt % methylnitroaniline), 670 grams of TMETN (with 1 wt % methylnitroaniline), and 11 grams of bismuth subsalicylate are added with 3 liters of acetone, and heated and stirred for 30 minutes at a temperature of 140° F. under a pressure of 20 mm Hg. The second step is repeated a third and fourth time under similar conditions. After the fourth step, the mixture is maintained at 140° F. for 120 minutes with the pressure gradually decreased to 3 mm Hg by the end of the first 60 minutes, with the pressure maintained at 3 mm Hg through the second 60 minute period. The resulting liquid is analyzed under thermogravimetric analysis (TGA) to verify complexation of the composition and removal of the acetone, with the TMETN that normally peaks at 130–135° F., expected to peak at approximately 165–170° F.

The foregoing summary, description, and examples of the invention are not intended to be limiting, but are only exemplary of the inventive features which are defined in the claims.

What is claimed is:

1. A complexed liquid fuel composition comprising:

a cyclodextrin nitrate;

a nitrate ester plasticizer;

bismuth subsalicylate; and, a stabilizer, wherein the cyclodextrin nitrate, nitrate ester plasticizer and bismuth subsalicylate are complexed together into an energetic compound.

2. The liquid fuel composition of claim 1, wherein the cyclodextrin nitrate comprises an energetic material selected from the group consisting of α-cyclodextrin, β-cyclodextrin, γ-cyclodextrin, and mixtures thereof.

3. The complexed liquid fuel composition of claim 2, wherein the cyclodextrin nitrate comprises γ-cyclodextrin nitrate.

4. The complexed liquid fuel composition of claim 1, wherein the cyclodextrin nitrate comprises from about 20 wt % to about 50 wt % of the complexed liquid fuel composition.

5. The complexed liquid fuel composition of claim 4, wherein the cyclodextrin nitrate comprises from about 25 wt % to about 40 wt % of the complexed liquid fuel composition.

6. The complexed liquid fulel composition of claim 5, wherein the cyclodextrin nitrate comprises approximately 32.5 wt % of the complexed liquid fuel composition.

7. The complexed liquid fuel composition of claim 1, wherein the nitrate ester plasticizer comprises and energetic material selected from the group consisting of 1,1,1-trimethylolethane trinitate (TMETN), 1,2,4-butanetriol trinitrate (BTTN), triethylene glycol dinitrate (TEGDN), nitroglycerin (NG), 1,2-propyleneglycol dinitrate (PGDN), pentaerythritol trinitrate (PETRIN), diethylene glycol dinitrate (DEGN), and mixtures thereof.

8. The complexed liquid fuel composition of claim 7, wherein the nitrate ester plasticizer comprises nitroglycerin (NG).

9. The complexed liquid fuel composition of claim 1, wherein the nitrate ester plasticizer comprises from about 50 wt % to about 80 wt % of the complexed liquid fuel composition.

10. The complexed liquid fuel composition of claim 9, wherein the nitrate ester plasticizer comprises from about 60 wt % to about 75 wt % of the complexed liquid fuel composition.

11. The complexed liquid fuel composition of claim 10, wherein the nitrate ester plasticizer comprises approximately 65 wt % of the complexed liquid fuel composition.

12. The complexed liquid fuel composition of claim 1, wherein the bismuth subsalicylate comprises from about 0.75 wt % to about 1.5 wt % of the complexed liquid fuiel composition.

13. The complexed liquid fuel composition of claim 1, wherein the stabilizer comprises a stabilizing compound having a pH of from about 7 or less selected from the group consisting of 2-nitrodiphenyl amine (2NDPA), methylnitroaniline (MNA) and combinations thereof.

14. The complexed liquid fuel composition of claim 1, wherein the stabilizer comprises from about 1 wt % to about 2 wt % of the complexed liquid fuiel composition.

* * * * *